United States Patent [19]

Müller et al.

[11] Patent Number: 4,713,127

[45] Date of Patent: Dec. 15, 1987

[54] TRIPLEBASIC PROPELLANT POWDER AND PROCESS FOR THE PRODUCTION THEREOF

[75] Inventors: Dietmar Müller, Karlsruhe; Jürgen Kremp, Vallendar, both of Fed. Rep. of Germany

[73] Assignee: Fraunhofer-Gesellschaft zur Forderung der angewandten, Munich, Fed. Rep. of Germany

[21] Appl. No.: 907,037

[22] Filed: Sep. 12, 1986

[30] Foreign Application Priority Data

Sep. 12, 1985 [DE] Fed. Rep. of Germany ..... 3532525

[51] Int. Cl.[4] ..... C06B 25/26

[52] U.S. Cl. ..... 149/98; 149/95; 149/100; 149/108.8; 149/109.6; 264/3.1

[58] Field of Search ..... 149/95, 98, 100, 109.6, 149/108.8; 264/3.1

[56] References Cited

U.S. PATENT DOCUMENTS 3,894,894 7/1975 Elrick ..... 149/19.4

4,486,317 12/1984 Sandell ..... 149/2

4,597,924 7/1986 Allen et al. ..... 149/19.4

*Primary Examiner*—Stephen J. Lechert, Jr.

*Attorney, Agent, or Firm*—McCormick, Paulding & Huber

[57] ABSTRACT

Triplebasic propellant powders consist of nitrocellulose, nitroglycerin or an equivalently acting explosive oil and crystalline nitroguanidino, which are processed by mixing with one another and plasticizing the NC by means of a solvent, e.g. acetone, as well as by kneading the mixture and subsequent shaping to solid propellant powder bodies. In order to improve the thermal stability, particularly the cold embrittlement behaviour, at least one organic titanate from the group of monoalkoxy, chelate, quaternary, neoalkoxy, cycloheteroatom or coordinated titanates and/or at least one organic zirconate from the group of neoalkoxy zirconates is added to the propellant powder in a proportion of $\leqq 2\%$, preferably $\leqq 0.5\%$. This addition improves the chemical stability of the propellant powder.

6 Claims, No Drawings

TRIPLEBASIC PROPELLANT POWDER AND PROCESS FOR THE PRODUCTION THEREOF

BACKGROUND OF THE INVENTION

The present invention relates to a triplebasic propellant powder comprising nitrocellulose (NC), nitroglycerin (NGL) or an equivalent explosive oil and crystalline nitroguanidine (NIGU), which can be processed to solid propellant bodies by mixing with one another, plastioizing the NC by means of a solvent, e.g. acetone, as well as kneading the mixture.

Compared with singlebasic and doublebasic prepellant powders, triplebasic propellant powders have the advantage of high power but limited barrel erosion, these characteristics mainly being due to the nitroguanidine content. This can range from 5% to over 50% by weight, reference being made e.g. to types M30, M31, NQ and MNF for the range between 45 and 53% by weight. These propellant powders are either processed discontinuously in kneaders or continuously in oxtrudoro to shaped bodies and in the latter case to propellant strands, which can then be cut to give bodies from which the propellant charges are prepared. Plasticizing and therefore shapability are mainly determined by the nitrocellulose content which, as a result of the solvent, e.g. acetone acquires a gel structure and binds in the other components.

The mechanical strength and in particular the brittleness behaviour is decisively influenced by the nitroguanidine mixed in in crystalline form. Particularly at low temperatures, it has an increased cold embrittlement tendency, even at conventional temperatures of use down to −40° C. When firing such propellant powders, particularly those with a high NIGU proportion, the cold embrittlement leads to very unfavourable interior ballistics, which can even make the powder unusable.

SUMMARY OF THE INVENTION

The problem of the invention is to improve the embrittlement behaviour of triplebasic propellant powders and in particular to reduce or prevent cold embrittlement.

This problem is solved in the case of a triplebasic propellant powder of the aforementioned structure by the addition or at least one organic titanate from the group of monoalkoxy, chelate, quaternary, neoalkoxy, cycloheteroatom or coordinated titanates and/or at least one organic zirconate from the group of neoalkoxy zirconates with a proportion of ≦2% by weight.

Practical tests on triplebasic propellant powders of the aforementioned structure have revealed that it is possible to completely prevent cold embrittlement at temperatures down to −40° C. and it is in particular possible to obtain better characteristics than can e.g. be obtained by optimizing the crystal shape and size of the nitroguanidine or e.g. by partially dissolving the NIGU crystals Parallel tests on propellant powders, whose cold embrittlement it was attempted to improve by adding polymers, led to the same results as regards cold embrittlement only being achieved when the polymer was added in a proportion of approximately 5% by weight. However, even when the polymer was added in a proportion of more than 2% by weight there were negative changes in the burning behaviour, which in the case of an equivalent in the cold embrittlement of 5% by weight even led to such polymer-bound, triplebasic propellant powders becoming unusable. However, as a result of the inventive addition of organic titanates or zirconates, the burning behaviour is not impaired and the power is retained compared with "pure" triplebasic propellant powders. The chemical stability of the propellant powder is also in no way impaired. A positive sideeffect was also discovered, in that the erosion action on the weapon is reduced, which can be attributed to titanium oxide deposits on burning. The cold embrittlement improvement is due to the fact that the titanates and zirconates are responsible for a better adhesion between the plasticized fractions and the NIGU crystals and consequently the structure and optionally also the adhesion between the crystals becomes more stable.

A significant and usually adequate improvement to the cold embrittlement has been obtained, on the basis of practical tests, with an organic titanate and/or organic zirconate proportion of 0.2 to 1%, preferably 0.2 to 0.5% by weight.

It is surprising that with such a small addition there is a significant improvement to the cold embrittlement. However, it is obvious that such a small amount does not have any influence on the burning behaviour and the power of the propellant powder.

As has already been indicated, triplebasic propellant powders are essentially prepared according to two methods. In the first method alcohol-moist NC, desensitized NGL or the equivalent explosive oil, crystalline NIGU and a solvent, e.g. acetone are fed into a discontinuously operating kneader, homogenized and plasticized and optionally the plasticized material is intermediately stored. This material is then shaped into propellant strands and then cut to bodies or granulated. According to the invention this process is modified in that the organic titanate and/or zirconate is added to the kneading formulation either directly or mixed with the solvent. As the organic titanates and zirconates are liquids, they can be homogeneously mixed without difficulty with the remaining components or can be added in a premix with the solvent.

In the second, continuous method, the aforementioned components are applied to an extruder and continuously shaped to propellant powder strands. This method also permits the production of the propellant powder according to the invention in that the organic titanate and/or zirconate is supplied to the extruder either directly, or mixed with the solvent, or mixed with the latter and the NGL or the equivalently acting explosive oil.

The improvement in the cold embrittlement of the inventively composed and prepared propellant powders was established by loading cylindrical test bodies axially and at right angles thereto by means of a clearly defined falling weight with clearly defined impact velocity, similar to the drop hammer test for measuring the mechanical ignition behaviour. The propellant bodies were loaded at +21° C. and −40° C. with a falling weight of 1 kg from a height of fall of 0.2 to 0.5 m. Propellant powder bodies with a seven-hole geometry were investigated (body diameter 8.6 mm and length 19.8 mm or diameter 8.0 mm and length 19.0 mm, individual body weight 1.30 to 1.45 g). Conclusions with regards to the cold embrittlement behaviour can be drawn from the fragments obtained on reaching the limit load. Triplebasic propellant powders of a conventional structure, including those with an optimized NIGU crystal shape and size and original comparison powders give fragments of different size and geometry on reaching the limit load and they have in particular a high proportion of fines and thin-walled webs, whereas propellant powders with the composition according to the invention and at the same limit load do not break and do not even suffer from cracking. Tests in the ballistic bomb with special fittings were used for further evaluation purposes.

Apart from the improvement to the cold embrittlement behaviour, storage tests at 90° C. revealed that the weight loss, which is a measure of the chemical stability of the propellant powder, was very low. In the case of all the investigated tests pieces with an addition of between 0.2 and 0.5% titanate by weight, the weight loss was roughly within equal limits and was surprisingly lower than in the "pure" propellant powder, from which it can be concluded that the addition or organic titanates or zirconates leads to a certain improvement in the chemical stability, whereas the addition of up to 2% by weight polymers leads to a significantly higher weight loss.

TABLE 1

FORMULATION OF TRIBASIC PROPELLANTS WITH MONOALKOXY TITANATE-ADDITIVE

| Nitrocellulose | Nitroglycerine | Nitroguanidine Wt. % | Centralit I | Cryolite | Additive Wt. % |
|---|---|---|---|---|---|
| 27.1 ± 1 | 24.1 ± 1 | 47.1 ± 2 | 1.3 | 0.4 | 0.2% Isopropyl- |
| 25 ± 2 | 20 ± 4 | 55.0 ± 5 | " | " | tri(dioctylphosphate) titanate |
| 27.1 ± 1 | 24.1 ± 1 | 47.1 ± 2 | " | " | 0.5% Isopropyl- |
| 25 ± 2 | 20 ± 4 | 55 ± 5 | " | " | tri(dioctylphosphate) titanate |
| 27.1 ± 1 | 24.1 ± 1 | 47.1 ± 2 | " | " | 0.2% isopropyl- |
| 25 ± 2 | 20 ± 4 | 55 ± 5 | " | " | triisostearoyltitanate |
| 27.1 ± 1 | 24.1 ± 1 | 47.1 ± 2 | " | " | 0.5% isopropyl- |
| 25 ± 2 | 20 ± 4 | 55 ± 5 | " | " | triisostearoyltitanate |

TABLE 2

FORMULATION OF TRIBASIC PROPELLANTS WITH ADDITIVES FROM THE GROUP OF (1) CHELATE TITANATE, (2) QUAT. TITANATE, (3) COORDINATE TITANATE, (4) NEOALKOXY TITANATE, (5) CYCLOHETEROATOM TITANATE, (6) NEOALKOXY ZIRCONATE

| Nitrocellulose | Nitroglycerine | Nitroguanidine Wt. % | Centralit I | Cryolite | Additive Wt. % | |
|---|---|---|---|---|---|---|
| 27.1 ± 1 | 24.1 ± 1 | 47.1 ± 2 | 1.3 | 0.4 | 0.2 | Group 1, 2, 3, |
| " | " | " | " | " | 0.5 | 4, 5, 6 |
| 25 ± 2 | 20 ± 4 | 55 ± 5 | " | " | 0.2 | Group 1, 2, 3, |
| " | " | " | " | " | 0.5 | 4, 5, 6 |

Representatives of
Group 1: Titanium-di-(cumylphenylate)-oxyacetate-Titanium-di-(dioctylpyrophosphate)-oxyacetate, Di-(dioctylphosphato)-ethylene titanate.
Group 2: Titanium-di-(cumylphenylate)-oxacetate + 2-dimethyl-aminomethylpropanol.
Group 3: Tetraisopropyl-di-(dioctylphosphito)-titanate.
Group 4: Neoalkoxy, trineodecanoyl-titanate.
Group 5: Dicyclo-(dioctyl)-pyrophosphato-dioctyl-titanate.
Group 6: Neoalkoxy-trisneodecanoyl-zirconate Neoalkoxy-tris(dioctyl)-phosphato-zirconate Neoalkoxy-tris-(m-amino)-phenyl-zirconate

What is claimed is:

1. A process for preparing a triplebasic propellant powder, from nitrocellulose (NC), an explosive oil (NGL) and crystalline nitroguanidine (NIGU), comprising the following steps; mixing with one another the NC, NGL and plasticising the NC by means of a solvent, kneading the mixture to give solid propellant bodies adding at least one organic titanate selected from the group of monoalkoxy, chelate, quaternary, neoalkoxy, cycloheteroatom or coordinated titanates and/or at least one organic zirconate from the group of neoalkoxy zirconates to provide a proportion of ≦2% by weight of such organic titanate and/or zirconate.

2. A propellant powder according to claim 1, wherein the organic titanate and/or organic ziroonate proportion is 0.2 to 1.0 and preferably 0.2 to 0.5% by weight.

3. A process for the preparation of a triplebasic propellant powder according to claims 1 or 2, in which alcohol-moist NC, sensitized NGL or the equivalently acting explosive oil, crystalline NIGU and a solvent, e.g. acetone are fed into a discontinuously operating kneader and homogenized, the plasticized material is intermediately stored and then shaped to a propellant body, wherein the organic titanate and/or zirconate is added to the kneading formulation either directly or mixed with the solvent.

4. A process for preparing a triplebasic propellant powder according to claims 1 or 2, in which alcohol-moist NC, sensitized explosive oil, crystalline NIGU and a solvent, are supplied to an extruder and continuously shaped to a propellant strand, and wherein the organic titanate and/or zirconate is supplied to the extruder directly, or mixed with the solvent, or mixed with the latter and the explosive oil.

5. The propellant prepared by the process of claim 1.

6. The propellant prepared by the process of claim 4.

* * * * *